US007827908B1

(12) United States Patent
Leon

(10) Patent No.: US 7,827,908 B1
(45) Date of Patent: Nov. 9, 2010

(54) SYSTEMS AND METHODS FOR PRINTING ON LARGE OR IRREGULAR ITEMS

(75) Inventor: JP Leon, Marina del Rey, CA (US)

(73) Assignee: Stamps.com Inc., Los Angeles, CA (US)

( * ) Notice: Subject to any disclaimer, the term of this patent is extended or adjusted under 35 U.S.C. 154(b) by 500 days.

(21) Appl. No.: 11/616,577

(22) Filed: Dec. 27, 2006

(51) Int. Cl.
*B41J 3/407* (2006.01)
*B41J 25/308* (2006.01)

(52) U.S. Cl. ..... 101/41; 400/58

(58) Field of Classification Search ..... 101/93, 101/41, 43; 347/2, 18, 8; 400/58, 59; *B41J 25/308, B41J 3/407*
See application file for complete search history.

(56) References Cited

U.S. PATENT DOCUMENTS 3,867,882 A * 2/1975 Ahlgren et al. ..... 101/35
5,101,224 A * 3/1992 Freed, Jr. ..... 346/145
5,308,173 A * 5/1994 Amano et al. ..... 400/29
5,685,651 A * 11/1997 Hayman et al. ..... 400/88
5,844,584 A * 12/1998 Murphy et al. ..... 347/20
5,923,438 A * 7/1999 Fujiwara ..... 358/401
6,208,980 B1 * 3/2001 Kara ..... 705/408
6,298,777 B1 * 10/2001 Dubois et al. ..... 101/27
2001/0024586 A1 * 9/2001 Day et al. ..... 400/88

OTHER PUBLICATIONS

U.S. Appl. No. 10/862,058, filed Jun. 4, 2004, Pagel et al.
U.S. Appl. No. 11/323,455, filed Dec. 30, 2005, Leon et al.
U.S. Appl. No. 11/324,181, filed Dec. 30, 2005, Leon et al.
U.S. Appl. No. 11/353,690, filed Feb. 14, 2006, Salim G. Kara.
U.S. Appl. No. 11/616,588, filed Dec. 27, 2006, J. P. Leon.

* cited by examiner

*Primary Examiner*—Judy Nguyen
*Assistant Examiner*—Jennifer Simmons
(74) *Attorney, Agent, or Firm*—Fulbright & Jaworski L.L.P.

(57) ABSTRACT

Systems and methods which employ a movable platen and associated print head which travel in a same direction to interact with a same surface of an item to be printed upon are shown. The movable platen according to embodiments includes a printing orifice through which the print head may interact with a surface of an item for printing. The movable platen preferably engages the surface of the item and applies a pressure thereto sufficient to substantially flatten the surface. Embodiments implement a print head platen which engages the surface of the item to be printed to provide flattening of the surface localized to the print head. A printer assembly of embodiments may not employ a lower platen or other structure to support an item to be printed, thereby facilitating the use of the printer with respect to any size of item.

41 Claims, 3 Drawing Sheets

SYSTEMS AND METHODS FOR PRINTING ON LARGE OR IRREGULAR ITEMS

CROSS-REFERENCE TO RELATED APPLICATIONS

The present application is related to co-pending and commonly assigned U.S. patent application Ser. No. 11/353,690 entitled "System and Method for Validating Postage," filed Feb. 14, 2006, Ser. No. 10/862,058 entitled "Virtual Security Device," filed Jun. 4, 2004, Ser. No. 11/324,180 entitled "Hybrid Postage Printer Systems and Methods," filed Dec. 30, 2005, Ser. No. 11/324,181 entitled "Hybrid Postage Printer Systems and Methods," filed Dec. 30, 2005, Ser. No. 11/323,455 entitled "Hybrid Postage Printer Systems and Methods," filed Dec. 30, 2005, Ser. No. 11/616,327 entitled "Postage Printer," filed concurrently herewith, the disclosures of which are hereby incorporated herein by reference.

TECHNICAL FIELD

The invention relates generally to printing and, more particularly, to facilitating printing on large or irregular items.

BACKGROUND OF THE INVENTION

Often it is desired to apply information to large or irregular items. For example, it is often desirable to apply postage indicia and other information, such as a mailing address, to parcels or to envelopes which have been filled with items to be mailed. However, parcels are typically too large and vary in size and shape too much from parcel to parcel to enable adapting a typical postage meter mechanism or other printer for printing postage indicia on parcels. Envelopes which have been filled with items to be mailed present items of varying thickness and which tend to result in non-flat surfaces making it difficult to adapt a typical postage meter mechanism or other printer for printing postage indicia on such envelopes.

Traditional postage meters have been unable to print postage indicia directly upon parcels. Instead, adhesive labels have been used, wherein a label is inserted into a postage meter for printing of a postage indicia thereon. The adhesive label may then be applied to a surface of the appropriate parcel.

Many traditional postage meters have been adapted to apply postage indicia to an envelope which has been filed with items to be mailed. For example, such postage meters have included a slot capable of accepting envelopes of varying thickness up to 5/16ths of an inch. A lower platen in the envelope printing area may be adapted to lift the envelope and apply force in the direction of an impact print mechanism. An impact print mechanism, which typically comprises an inked die shaped to print the desired postage indicia, is moved rapidly toward the face of the envelope (moved in the direction of the platen supporting the envelope) to impress a postage indicia image thereon. Such mechanisms have been successful in applying relatively simple postage indicia and/or other information to items of varying thickness and slightly non-flat surfaces. However, such mechanisms have not been successful with respect more complex printing operations, such as information based indicia (IBI) having machine readable barcode therein.

Attempts have been made to adapt printers capable of printing more complex postage indicia, such as the aforementioned IBI, for printing upon envelopes which have been filled with items to be mailed. Such attempts have included ink jet printing mechanisms using a lifting platen and a print head lowering assembly to accommodate envelopes of varying thickness up to 3/8ths of an inch. However, such mechanisms are complicated, requiring both a mechanism to raise the lower platen and to lower the print head. Moreover, such mechanisms do not address the problem of the surfaces of the envelope which has been filled with items to be mailed not being flat, particularly at or near the edges of the envelope. Such mechanisms tend to provide acceptable printing of complex postage indicia only in areas of the envelope surface where it is relatively flat, and generally result in a higher than traditional number of unusable postage indicia (e.g., a barcode is deformed or imperfect to the point that the information therein cannot be read by a machine).

As can be appreciated from the above, postage meters or other printers generally available for use in printing postage indicia have heretofore been unable to print postage indicia or other information directly upon parcels. Postage meters or other printers available for use in printing postage indicia have been limited with respect to the range of envelope thicknesses which can be accommodated and have met with only limited success with respect to printing complex postage indicia. Moreover, such postage meters or other printers have been complicated and expensive, despite their limitations with respect to the sizes and shapes of items that may be printed upon.

BRIEF SUMMARY OF THE INVENTION

The present invention is directed to systems and methods which employ a movable platen and associated print head which travel in a same direction to interact with a same surface of an item to be printed upon. The movable platen according to embodiments of the invention includes a printing orifice defined therein through which the print head may interact with a surface of an item for printing. The printing orifice of a preferred embodiment defines a printing area sufficient to complete printing of all desired information, such as a postage indicium and associated addresses.

In operation according to embodiments of the invention, the movable platen and print head travel in a first direction (e.g., along the Z axis) which is perpendicular to a surface of an item to receive printing. The movable platen preferably engages the surface of the item and applies a pressure thereto sufficient to substantially flatten the surface where the surface comprises a slightly bulging sheet material (e.g., an envelope which has been filed with items to be mailed). The movement of the movable print head in the first direction (along the Z axis) is preferably halted after the movable platen engages the surface, applying the desired pressure thereto, but before the print head engages the surface. Thereafter, the print head may be moved in a second and/or third direction (e.g., along the X and/or Y axes), within the printing orifice of the platen, to provide printing upon the surface. For example, the print head may comprise an ink nozzle (e.g., ink jet) print head which delivers controlled "dots" of ink to define a desired image.

Embodiments of the invention implement a print head platen in addition to the aforementioned movable platen. The print head platen is preferably moved in conjunction with the print head. That is, a preferred embodiment moves the print head platen in the first direction (e.g., along the Z axis) as the print head is moved in the first direction. Likewise, the print head platen is preferably moved in a second and/or third direction (e.g., along the X and/or Y axes) with the print head during printing. However, unlike the print head of preferred embodiments, the print head platen engages the surface of the item to be printed. For example, the print head platen may engage the surface with less force than the movable platen in order to provide flattening of the surface localized to the print head while allowing freedom of movement of the print head in the second and/or third directions. Embodiments of the print head platen provide a printing orifice through which a printing delivery system (e.g., ink nozzles) of the print head may interact with the surface to provide printing thereon, thereby providing flattening of the surface in an area encircling the print head printing delivery system.

A printer assembly implementing a movable platen and print head of embodiments of the invention may not employ a lower platen or other structure to support an item to be printed, thereby facilitating the use of the printer with respect to any size of item. For example, without a lower platen for supporting an item to be printed, a printer assembly implementing a movable platen and print head may be placed upon a surface of any sized parcel for printing thereon. Similarly, the printer assembly may be placed anywhere upon a surface of an envelope or other item to receive printing.

Embodiments of the invention may be employed with respect to a printer assembly having a lower platen or other structure to support an item to be printed. For example, a base platen may be provided over which a movable platen and print head of an embodiment of the invention are disposed. Upon placing an envelope or other item upon the base platen, the movable platen and print head may be moved such that the movable platen engages the surface with a desired force. Such a printer assembly may be comprised of a base unit providing the base platen and a printing unit comprising the movable platen and print head. According to embodiments of the invention, the printing unit may be separated from the base unit to thereby provide a printer assembly which is usable as described above without the base platen.

From the above, it can be appreciated that printer assemblies of embodiments of the present invention are adapted to print postage indicia or other information directly upon parcels or other large items. Printer assemblies of such embodiments are not limited with respect to the range of thicknesses, whether envelopes, parcels, or other items, which can be accommodated. Moreover, the use of one or more platens to engage the surface of an item to be printed provides a substantially flat surface for receiving the printing and thus improved success with respect to complex printing operations, such as associated with information based postage indicia. Moreover, such printer assemblies utilize less complicated and less expensive mechanisms than have heretofore been available.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWING

For a more complete understanding of the present invention, reference is now made to the following descriptions taken in conjunction with the accompanying drawing, in which.

DETAILED DESCRIPTION OF THE INVENTION

Figure 1A:
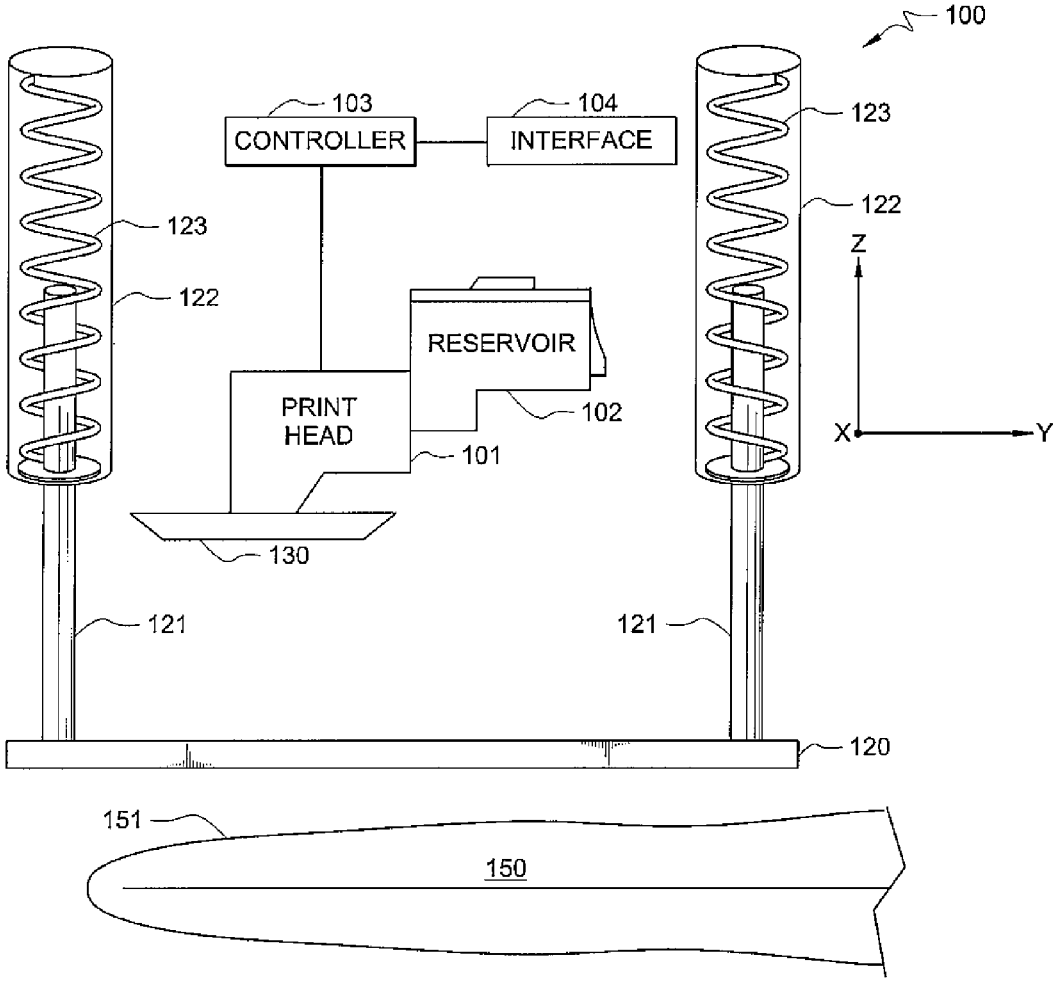
FIGS. 1A and 1B show an embodiment of the invention having a movable platen and associated print head.
Figure 1B:
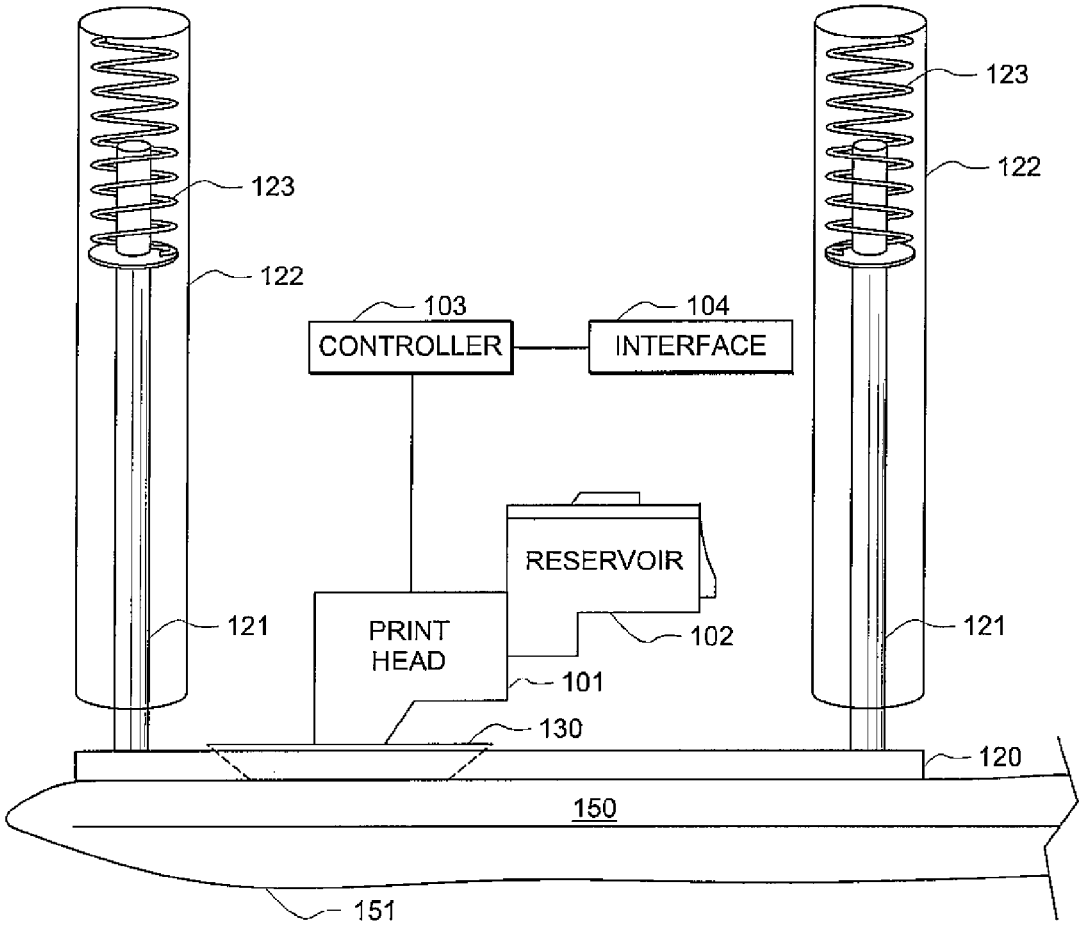

Directing attention to FIGS. 1A and 1B, an embodiment of the present invention employing a movable platen and print head which travel in a same direction to interact with a same surface of an item to be printed upon is shown. Specifically, the embodiment of printer 100 illustrated in FIGS. 1A and 1B include movable platen 120 and print head 101 which are both movable along the Z axis to interact with surface 151 of item 150.

Print head 101 may comprise an ink nozzle print head or other print delivery mechanism (e.g., thermal wax printer, thermal transfer printer, dot matrix printer, etcetera) suitable for printing desired information (e.g., information based postage indicia, recipient addresses, sender addresses, images, graphics, barcodes, etcetera). Reservoir 102 preferably stores print media (e.g., ink, wax, thermal transfer film, ribbon, etcetera) for use by print head 101. Controller 103 preferably includes circuitry and logic for controlling printing by print head 101, such as to control movement of movable platen 120 and print head 101 to interact with surface 151 (e.g., along the Z axis) and to control movement (e.g., along the X and/or Y axes) and operation (e.g., to impart printing media) of print head 101 to print upon surface 151. Interface 104 provides a data interface between printer 100 and one or more external systems (e.g., a host computer system, a postage server system, a network, etcetera) and may comprise a wired or wireless interface.

Although not shown in FIGS. 1A and 1B, various additional or alternative components may be utilized according to embodiments of the invention. For example, print head 101 may be coupled to a one dimensional carriage mechanism (e.g., print head carriage mechanism) to provide movement along the X axis or a two dimensional carriage mechanism (e.g., print head carriage mechanism and bridge carriage mechanism) to provide movement along the X and Y axes. Printer 100 may include a power supply, such as may be line powered or as may comprise a battery, for powering print head 101, controller 103, interface 104, various motors, etcetera.

Item 150 may comprise any item upon which printing is to be applied. For example, item 150 may comprise an envelope which has been filled with items to be mailed. Alternatively, item 150 may comprise a parcel or other large item.

In the illustration of FIG. 1A, movable platen 120 has not engaged surface 151 of item 150. Therefore, spars 121 are extended substantially fully from receivers 122, as may be encouraged by bias members 123 (e.g., compression springs). In the illustration of FIG. 1B, movable platen 120 and print head 101 have been translated along the Z axis toward item 150 to a point at which movable platen 120 has engaged surface 151 of item 150 and at which print head 101 is properly positioned for printing upon surface 151 (e.g., a small gap may remain between print head 101 and surface 151 as is typical for ink nozzle printing operation). Movable platen 120 in FIG. 1B preferably exerts a force upon surface 151 sufficient to substantially flatten the surface. For example, bias members 123 may provided a bias force to platen 120 through spars 121 predetermined to provide a pressure to surface 151 sufficient to substantially flatten the surface where item 150 comprises an envelope which has been filed with items to be mailed when print head 101 is in a proper position for printing upon surface 151. Pressure applied to surface 151 by platen 120 of embodiments of the invention is in the range of approximately 1-10 pounds per square inch.

Print head 101 and movable platen 120 of embodiments of the invention move together in relation to item 150, such that when movable platen 120 has applied a predetermined amount of force to surface 151 print head 101 is properly positioned with respect to surface 151 for printing. For example, print head 101 may be coupled to receivers 123 such that there is no relative movement along the Z axis between print head 101 and receivers 123. Thus as movable platen 120 is moved toward item 150, print head 101 is also moved toward item 150. As movable platen 120 engages surface 151, causing spars 121 to retract into receivers 123, thus resulting in relative movement between print head 101 and movable platen 120 (although there is no relative movement between print head 101 and receivers 123). A stop (not shown) may be provided with respect to receivers 123 and spars 121 such that the relative movement between print head 101 and movable platen 120 is stopped at a point where print head 101 is properly positioned for printing upon surface 151.

According to alternative embodiments, print head 101 and movable platen 120 may be moved independently in relation to item 150, such that when movable platen 120 is moved with respect to item 150 print head 101 may remain unmoved with respect to item 150. In such an embodiment, movable platen may be moved toward item 150 to engage surface 151, causing spars 121 to retract into receivers 123, to a point at which a desired amount of pressure is applied to surface 151 by movable platen 120. Thereafter, print head 101 may be moved toward item 150 to a point where print head 101 is properly positioned for printing upon surface 151.

Figure 2:
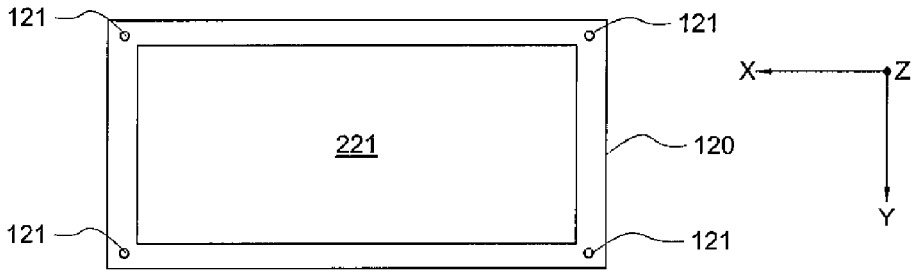
FIG. 2 shows detail with respect to an embodiment of the movable platen of FIGS. 1A and 1B.

As shown in FIG. 2, movable platen 120 of embodiments includes printing orifice 221 defined therein. Printing orifice 221 provides an opening through which print head 101 may interact with surface 151 for printing thereon. Specifically, print head 101 of preferred embodiments may be moved along the X and/or Y axes within printing orifice 221 to provide printing upon an area of surface 151 corresponding to printing orifice 221. Printing orifice 221 of a preferred embodiment defines a printing area sufficient to complete printing of all desired information, such as a postage indicium and associated addresses. For example, printing orifice 221 of embodiments provides an opening sized so as to allow freedom of movement of print head 101 sufficient to print a 4 inch by 6 inch area. Such an area is large enough to print a shipping label including a postage indicium, recipient address, shipper address, and special delivery instructions as used on a typical parcel as well as to print a postage indicium, recipient address, and shipper address in the configuration typically used on an envelope. It should be appreciated, however, that printing orifices sized and/or shaped differently than that of FIG. 2 may be utilized according to embodiments of the invention.

Although the embodiment of FIG. 2 shows 4 spars disposed at the corners of movable platen 120 to provide relatively even biasing of movable platen 120, different numbers and configurations of spars may be utilized according to embodiments of the invention. For example, spars may be disposed along the sides of movable platen 120 rather than at the corners. Additionally, spars may be disposed only along 2 sides of movable platen 120. Any configuration determined to provide desired biasing of movable platen 120 for presenting a substantially flat surface for printing may be utilized according to embodiments of the invention.

Referring again to FIGS. 1A and 1B, embodiments of the invention implement print head platen 130 in addition to movable platen 120. Print head platen 130 is preferably moved in conjunction with print head 101. For example, a preferred embodiment moves print head platen 130 along the Z axis as print head 101 is moved along the Z axis toward item 150. Likewise, print head platen 130 is preferably moved in along the X and/or Y axes with print head 101 during printing upon surface 151.

Print head platen 130 preferably engages surface 151 when print head 101 is disposed in a position for printing upon surface 151. According to a preferred embodiment, print head platen 130 engages surface 151 with less force than movable platen 120 engages surface 151 in order to provide localized flattening of surface 151 while allowing freedom of movement of print head 101 for printing. That is, print head platen 130 of embodiments of the invention provides a flattening force to surface 151 which is localized to print head 101, thereby providing flattening of surface 151 supplemental to that provided by movable platen 120. The flattening force provided by print head platen 130 is preferably adjacent to an area currently being printed by print head 101. As print head 101 is moved throughout the printing operation, print head platen 130 of the preferred embodiment is also moved to maintain the supplemental flattening force adjacent to the area currently being printed. Pressure applied to surface 151 by print head platen 130 of embodiments of the invention is variable, such as within the range of approximately 1-10 pounds per square inch. For example, as print head 101 of embodiments is moved over surface 151 for printing thereon, a force exerted upon the surface by the print head platen may vary as the print head platen encounters surface areas which are less planar (e.g., more bulbous). Additionally or alternatively, the pressure applied to surface 151 by print head platen 130 may be varied based upon other attributes or criteria, such as the texture or coefficient of friction associated with the surfaces being interfaced to thereby avoid distorted printing or failure of print head 101 to move properly during a print operation.

Figure 3:
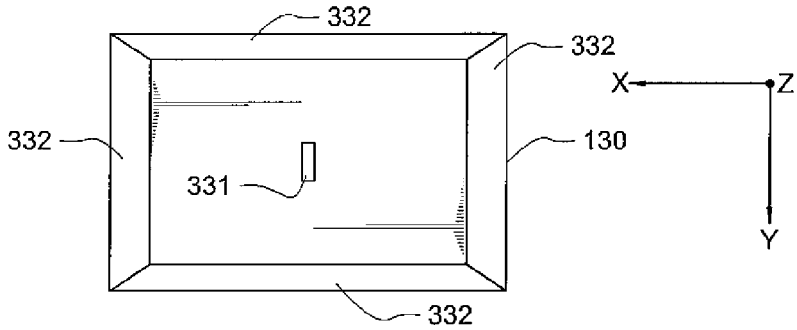
FIG. 3 shows detail with respect to an embodiment of the print head platen of FIGS. 1A and 1B.

As shown in FIG. 3, embodiments of print head platen 130 provide a printing orifice through which a printing delivery system (e.g., ink nozzles) of print head 110 may interact with surface 151 to provide printing thereon. Specifically, the embodiment of print head platen 130 illustrated in FIG. 3 includes printing orifice 331 through which ink or other print media may be delivered to surface 151. Also illustrated in the embodiment of FIG. 3 are tapered edges 332 along the periphery of print head mask 130. Tapered edges 332 of the illustrated embodiment facilitate movement of print head platen 130 along the X and Y axes while applying the aforementioned flattening force to surface 151. In embodiments where only movement along the X or Y axis is provided while print head platen 130 engages surface 151, tapered edges may be provided only along corresponding edges of print head platen 130, if desired. Moreover, embodiments of the invention may omit the tapered edges, if desired.

Although embodiments have been described above with respect to a movable platen providing relative movement with respect to an associated print head, embodiments of the invention utilize a platen which, although movable with respect to an item to be printed upon, does not provide relative movement with respect to an associated print head. For example, a movable platen of an embodiment of the invention may be fixed, with respect to an associated print head, in a position as illustrated in FIG. 1B. The movable platen and print head may be moved together to interact with a surface of an item for printing.

Embodiments of the invention may provide relative movement between a movable platen and associated print head through movement of the print head in addition to or the alternative to movement by the movable platen. For example, rather than providing a retractable configuration of a movable platen as shown in FIGS. 1A and 1B, the movable platen may be rigidly affixed to a printer assembly and the associated print head may provide relative movement between the movable platen and the print head, it being understood that the print assembly may provide relative movement with respect to the movable platen and an item for printing.

Figure 4:
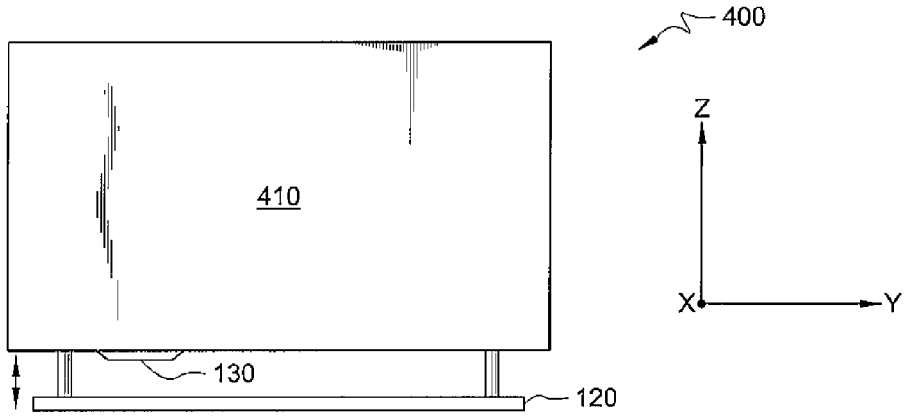
FIGS. 4 and 5 show embodiments of printer assemblies implementing the movable platen and associated print head of FIGS. 1A and 1B.

A printer assembly implementing movable platen 120 and print head 101 of embodiments of the invention may not employ a lower platen or other structure to support an item to be printed, thereby facilitating the use of the printer with respect to any size of item. Directing attention to FIG. 4, an embodiment of such a printer assembly configuration is shown wherein printer 400 includes housing 410 incarcerating print head 101, controller 103, and receivers 123. Movable platen 120 extends from the bottom of housing 410 of the illustrated embodiment such that printer 400 may be placed upon a surface of an item to be printed (e.g., surface 151 of item 150). Printer 400 may be configured such that a weight of the printer is sufficient to cause movable platen 120 to apply a desired force to the surface of the item and to cause print head 101 to travel along the Z axis to a proper position for printing upon the surface. Alternatively, external or additional forces may be applied to result in desired force being applied by movable platen 120 and/or proper positioning of print head 101. For example, manual pressure may be applied to housing 410 to transfer a desired amount of force to the interface between movable platen 120 and a surface of the item and/or to cause print head 101 to be properly positioned with respect to the item's surface. Automated means, such as a stepper motor and associated mechanical linkage, may be used for providing desired positioning etcetera. For example, once motion along the Z axis has ceased with respect to movable platen 120, a stepper motor may be controlled by controller 103 to move print head 101 and print head platen 130 into a proper position with respect to the item's surface.

Without a lower platen for supporting an item to be printed, printer 400 may be placed upon a surface of any sized parcel for printing thereon. Similarly, printer 400 may be placed anywhere upon a surface of an envelope or other item to receive printing. Accordingly, printer 400 may be used with respect to most any sized item. Moreover, printer 400 may be utilized to print information, including complex information based postage indicia, directly upon parcels and other large items.

Figure 5:
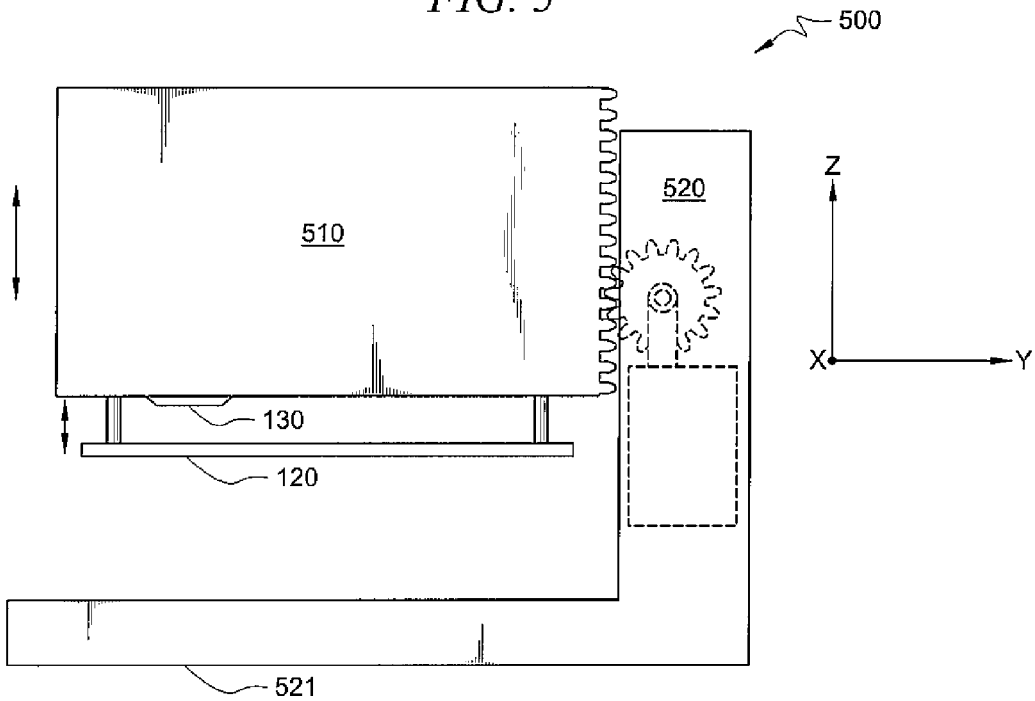

According to alternative embodiments, a printer assembly implementing movable platen 120 and print head 101 may employ a lower platen or other structure to support an item to be printed, if desired. Directing attention to FIG. 5, an embodiment of such a printer assembly configuration is shown wherein printer 500 includes housing 510 incarcerating print head 101, controller 103, and receivers 123. As with printer 400 discussed above, movable platen 120 extends from the bottom of housing 510. However, structure 520 supports housing 510 above base platen 521. Housing 510 may be lowered along structure 520 toward base platen 521 to cause movable platen 120 to engage a surface of an item (e.g., surface 151 of item 150) which is supported by base platen 521. For example, structure 520 and housing 510 may comprise guides, mechanical linkages, etcetera to facilitate controlled movement of housing 510 with respect to base platen 521. Such movement may be provided by manual means (e.g., by a user's hand directly upon housing 510, through a leaver, etcetera) or by automated means (e.g., a stepper motor and associated mechanical linkage controlled by controller 103). Upon placing an envelope or other item upon base platen 521, movable platen 120 and print head 101 may be moved such that movable platen 120 engages the surface with a desired force and print head 101 is properly positioned for printing upon the surface.

It should be appreciated that the foregoing printer operable without a lower platen and printer operable with a lower platen need not be provided in alternative embodiments. According to embodiments of the invention, housing 510 is removable from structure 520 to result in a printer unit operable as described above with respect to printer 400.

Printers having a movable platen and associated print head according to embodiments of the present invention may be provided in a variety of configurations. For example, printers (e.g., printers 400 and 500) of embodiments of the invention may be configured as a printer peripheral such that only limited control (e.g., on/off, offline select, cancel job, etcetera) is available at the printer unit itself. Primary control of such a printer configuration may be provided by a host system, such as a personal computer and/or print server, coupled to the printer (e.g., via interface 104). In a postage printing environment, for example, the host may be operable under control of postage printing software, such as shown and described in the above referenced patent applications entitled "System and Method for Validating Postage" and "Virtual Security Device." Alternatively, printers (e.g., printers 400 and 500) of embodiments of the invention may be configured as a stand-alone, or quasi stand-alone, printing apparatus such that substantial control (e.g., data input, print selection, print control, etcetera) is available at the printer unit itself. Printer configurations providing stand-alone, or quasi stand-alone, operation as may be implemented according to embodiments of the invention are shown in the above referenced patent applications entitled "Hybrid Postage Printer Systems and Methods" and the above referenced patent application entitled "Postage Printer."

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A system comprising:

a print head for printing information upon a surface of an item;

a platen movable relative to the print head in a first direction to interface with said surface and apply a desired amount of pressure thereto, wherein said movable platen includes a printing orifice through which said print head prints said information upon said surface when said platen is interfaced with said surface; and a print head platen to interface with said surface and apply a second desired amount of pressure thereto.

2. The system of claim 1, wherein said print head comprises an ink nozzle print head.

3. The system of claim 1, wherein said print head is moved in said first direction in conjunction with movement of said movable platen in said first direction.

4. The system of claim 3, wherein said first direction is perpendicular to said surface.

5. The system of claim 1, wherein said print head is movable in a second direction within confines of said printing orifice for said printing information upon said surface.

6. The system of claim 5, wherein said print head is also movable in a third direction within confines of said printing orifice for said printing information upon said surface.

7. The system of claim 1, wherein a size of said printing orifice is selected to allow said print head to print an area of at least 4 inches by 6 inches without movement of said movable platen after having interfaced with said surface.

8. The system of claim 1, wherein said information comprises an information based postage indicia.

9. The system of claim 8, wherein said information further comprises address information.

10. The system of claim 1, wherein said desired amount of pressure comprises an amount of pressure selected so as to flatten said surface for said printing.

11. The system of claim 1, wherein said second desired amount of pressure is less than said desired amount of pressure.

12. The system of claim 1, wherein said print head platen includes a printing orifice through which said print head interacts with said surface to provide said printing thereon.

13. The system of claim 1, wherein said print head and movable platen comprise part of a printer assembly having a platen disposed only on a same side of said item as said surface.

14. The system of claim 13, wherein said printer assembly does not include a base platen for supporting said item during said printing.

15. The system of claim 1, wherein said print head and movable platen comprise part of a printer assembly providing a support structure having a base platen for supporting said item during said printing.

16. The system of claim 15, wherein an assembly including said print head and said movable platen is detachable from said support structure to thereby allow said printing on said item without said item being supported by said base platen.

17. The system of claim 1, wherein said item comprises a parcel.

18. The system of claim 1, wherein said item comprises an envelope which has been filled with one or more items to be mailed.

19. The system of claim 1 wherein said system is a standalone postage printer.

20. A method comprising:

moving a platen to interface with a surface of an item onto which printing is desired;

causing said platen to impart a desired amount of force to said surface;

disposing a print head in a desired position with respect to said surface for printing, said desired position leaving a gap between said print head and said surface; and moving said print head to deliver a printing medium to said surface for printing information;

wherein said disposing said print head in said desired position comprises:

disposing a print head platen to interface with said surface; and causing said print head platen to impart a second desired amount of force to said surface.

21. The method of claim 20, wherein said platen includes a printing orifice through which said print head prints said information.

22. The method of claim 21, wherein said moving said print head is constrained by a size of said printing orifice.

23. The method of claim 21, wherein a size of said printing orifice is selected to allow said print head to print an area on said surface of at least 4 inches by 6 inches without moving said platen after interfacing with said surface.

24. The method of claim 21, wherein said moving said print head comprises:

moving said print head along a first axis; and moving said print head along a second axis, said second axis being perpendicular to said first axis.

25. The method of claim 24, wherein said moving said platen to interface with said surface comprises:

moving said platen along a third axis, said third axis being perpendicular to said first and second axes.

26. The method of claim 20, wherein said second desired amount of force is less than said desired amount of force.

27. The method of claim 20, wherein said print head platen includes a printing orifice through which said print head delivers said printing medium.

28. The method of claim 20, wherein said causing said platen to impart said desired amount of force to said surface comprises:

allowing a weight of a printer assembly including said print head and said platen to impart at least a portion of said desired amount of force.

29. The method of claim 20, wherein said causing said platen to impart said desired amount of force to said surface comprises:

manually applying force to a printer assembly including said print head and said platen to impart at least a portion of said desired amount of force.

30. The method of claim 20, wherein said moving said platen to interface with said surface comprises:

placing a printer assembly including said print head and said platen onto said item, wherein said item is not supported by any surface of said printer assembly.

31. The method of claim 20, wherein said moving said platen to interface with said surface comprises:

moving said platen in relation to a base platen of a printer assembly including said print head and said platen.

32. The method of claim 20, wherein said causing said platen to impart a desired amount of force causes said surface of said item to flatten for printing by said print head.

33. The method of claim 20, wherein said item comprises a parcel box.

34. The method of claim 20, wherein said item comprises an envelope having at least one item to be mailed therein.

35. A postage indicia printing system, said system comprising:

a print head for printing an information based postage indicia upon a surface of an item, said print head movable in at least a first direction for said printing;

a platen movable in a second direction to interface with said surface, said second direction being perpendicular to said first direction, wherein said platen includes a first printing orifice defining an area of printing movement of said print head; and a print head platen coupled to said print head and movable therewith to interface with said surface, wherein said print head platen includes a second printing orifice through which said print head delivers a print medium to said surface, wherein said platen applies a first amount of pressure to said surface when interfaced therewith, and wherein said print head platen applies a second amount of pressure to said surface when interfaced therewith.

36. The system of claim 35, wherein said area of printing comprises an area sufficient for printing a complete mailing label for said item.

37. The system of claim 35, wherein said area of printing comprises an area sufficient to print address information in addition to said information based postage indicia.

38. The system of claim 35, wherein said information based postage indicia includes a human readable portion and a machine readable barcode portion.

39. The system of claim 35, wherein said first amount of pressure provides a flattening force to said surface throughout said area of printing, and wherein said second amount of pressure provides a flattening force localized to said print head.

40. The system of claim 35, wherein said print head is further movable in a third direction for said printing, said third direction being perpendicular to both said first and second directions.

41. The system of claim 35, wherein said print head, said platen, and said print head platen comprise a printer assembly which is set freely upon said surface of said item without use of any structure interfacing with another surface of said item.

* * * * *